US005385270A

United States Patent [19]

Cataneo et al.

[11] Patent Number: 5,385,270

[45] Date of Patent: Jan. 31, 1995

[54] SELECTABLE RATIO DISPENSING APPARATUS

[76] Inventors: Ralph J. Cataneo, 1169 E. 21st St., Brooklyn, N.Y. 11200; Robert J. Tannenbaum, 13 Coventry Dr., Freehold, N.J. 07728

[21] Appl. No.: 84,844

[22] Filed: Jun. 29, 1993

[51] Int. Cl.[6] ..... B67D 5/60

[52] U.S. Cl. ..... 222/134; 222/136; 222/137; 222/144.5; 222/145; 222/212; 222/383

[58] Field of Search ..... 222/134, 136, 137, 144.5, 222/145, 212, 383

[56] References Cited

U.S. PATENT DOCUMENTS

| | | | |
|---|---|---|---|
| 1,667,818 | 5/1928 | Page | 222/144.5 |
| 3,760,986 | 9/1973 | Castner et al. | 222/137 |
| 3,876,112 | 4/1975 | Kramer | 222/132 |
| 4,271,984 | 6/1981 | Ducros et al. | 222/94 |
| 4,335,837 | 6/1982 | Bono | 222/137 |
| 4,549,674 | 10/1985 | Alticosalian | 222/144.5 X |
| 4,687,663 | 8/1987 | Schaeffer | 424/52 |
| 4,771,919 | 9/1988 | Ernst | 222/134 |
| 4,838,457 | 6/1989 | Swahl et al. | 222/48 |
| 4,884,703 | 12/1989 | O'Meara | 215/6 |
| 4,893,729 | 1/1990 | Iggulden et al. | 222/42 |
| 4,964,539 | 10/1990 | Mueller | 222/94 |
| 4,974,756 | 12/1990 | Pearson et al. | 222/562 |
| 4,993,594 | 2/1991 | Decker et al. | 222/48 |
| 5,102,016 | 8/1992 | Ball et al. | 222/145 |
| 5,137,178 | 8/1992 | Stokes et al. | 222/94 |

FOREIGN PATENT DOCUMENTS

| | | | |
|---|---|---|---|
| 629354 | 4/1936 | Germany | 222/144.5 |
| 910791 | 11/1962 | United Kingdom | 222/383 |
| 2064664 | 6/1981 | United Kingdom | 222/137 |

*Primary Examiner*—Andres Kashnikow
*Assistant Examiner*—Joseph A. Kaufman
*Attorney, Agent, or Firm*—Panitch Schwarze Jacobs & Nadel

[57] ABSTRACT

An apparatus for dispensing two flowable substances in a user selectable ratio having a container and a selector member. The container includes a dispensing end, a flexible continuous outer wall, and a flexible inner diaphragm separating the container into two generally equal chambers for each receiving a different flowable substance. Each of the chambers includes an end generally open proximate the dispensing end of the container. The selector member is disposed between the open ends of the chambers and the dispensing end of the container and includes a single opening extending therethrough. The selector member is selectively rotatable with respect to the container between a series of predetermined positions where the selector member opening is either in full registry, partial registry or not in registry with the open ends of each of the chambers such that upon compression of the outer container wall, a predetermined measure of flowable substance is dispensed from the dispensing end of the container with the ratio of the flowable substance from the two chambers which constitutes the predetermined measure being selectively variable.

19 Claims, 3 Drawing Sheets

SELECTABLE RATIO DISPENSING APPARATUS

FIELD OF THE INVENTION

The present invention relates generally to an apparatus for co-dispensing two flowable substances and, more particularly, to a dispenser for holding, selecting and co-dispensing a mixture of two flowable substances in a user selectable ratio.

BACKGROUND OF THE INVENTION

Dispensing units having multiple chambers for holding different flowable substances are generally known. In one prior art dispenser, the flowable substances are stored in separate compressible chambers within a container, each chamber being provided with a dip tube. Secured to the top of the container is a metering and mixing output section. A metering mechanism includes a shaft on which are mounted a series of cams and a selector dial coupled to the shaft which functions as a control element to rotate the cams, each cam being arranged in the course of rotation to more or less pinch a respective dip tube and thereby determine the volume of constituent flow from each of the chambers into the output section.

Another prior art dispenser for holding metering, mixing and dispensing a mixture of two substances comprises a container having two compartments for containing the two substances and a cylindrical neck at the top of the container containing a first bore and a second bore each communicating with a respective chamber of the container. A cylindrical mixing chamber communicating with the first and second bores is disposed over the cylindrical neck and includes a third bore on a top end thereof for the egress of the two substances. The dispenser also includes a selector dial having a central opening concentrically disposed over the first bore for dispensing the substance from one of the compartments. A plurality of various diameter metering openings are disposed peripherally around the selector dial concentrically disposed to pass over the second bore as the selector dial is rotated such that the substance being dispensed from the other compartment is adjustable.

A third prior art dispenser comprises a cylindrical housing having a dispensing end and a storage chamber enclosing a pair of containers for receiving flowable substances which are removably mounted on a mounting block. The block is provided with a pair of openings on an annular surface having a central projection about which a selector dial rotates. The projection includes a pair of passageways in fixed alignment with the openings so as to conduct a flowable substance therethrough. A regulating disc including a plurality of different sized openings is movably disposed on the annular surface for revolving about the projection. When the disc is moved in response to rotation of the selector dial, a selected disc opening is placed in registry between a block opening and a respective passageway to permit the flowable substance within each container to pass into blending relationship at the dispensing end.

The above-mentioned prior art dispensers provide metering by means of varying the openings of the chambers disposed within the container by means of a dial valve or regulating disc to restrict the flow of material, and thereby alter the proportions of liquid by means of the restriction. These dispensers have erred in their conception that the substances are dispensed by exerting equal pressure on the compressible chambers within the compressible outer container. The results of applying pressure as described when holes are close in diameter does not result in altering the volume of material extruded through the holes in any predictably variable way other than as a function of the amount of pressure exerted. Another disadvantage of the prior art dispensers is that they all employ a relative complex structure involving relative high manufacturing costs.

The present invention overcomes many of the disadvantages inherent in the above-described prior art dispensers by providing an apparatus for dispensing two flowable substances in a user selectable ratio in which the volume flow varies proportionally with the application of pressure in a predictable manner. The dispensing apparatus in one embodiment comprises a container having a dispensing end, a flexible outer wall and a flexible inner diaphragm separating the container into two generally equal chambers having open ends for receiving a different flowable substance. A selector member having a single opening extending therethrough is disposed between the open ends of the chambers and the dispensing end of the container. The selector member is selectively rotatable with respect to the container through a series of positions in which the selector member either completely or partially restricts the open ends of the chambers in proportional ratios. Upon compression of the outer wall of the container, the flexible diaphragm regulates the specific pressure at the open ends of the chambers by distributing the pressure within the chambers in response to the back pressure or lack thereof resulting from the restriction of the open ends of the chambers by the selector member. A pressure differential between the chambers is thus created allowing a predictable flow of substance through each chamber opening. Hence, the present invention overcomes the unpractical designs of the prior art selectable mixing dispensers which only properly function if uniform and constant pressure is exerted on the container, since any variation in pressure alters the resulting output of each flowable substance so as to make a uniform mixed output of the flowable substances at a selectable ratio difficult to achieve.

Another practical advantage of the dispensing apparatus of the present invention is that the structure allows for compact design, thus resulting in more economical construction than prior art dispensers employing metering and mixing devices.

SUMMARY OF THE INVENTION

Briefly stated, the present invention comprises an apparatus for dispensing two flowable substances in a user selectable ratio. In one embodiment, the apparatus comprises a container having a flexible, generally continuous outer wall and a flexible, inner diaphragm separating the container into two generally equal chambers, each chamber receiving a different flowable substance. The container has a generally open dispensing end and a generally closed end. Each of the chambers has an end generally open proximate the dispensing end of the container. A selector member having a single opening of a predetermined size and a predetermined shape extending therethrough is disposed between the open ends of the chambers and the dispensing end of the container. The selector member is selectively rotatable with respect to the container from a first position in which the opening is in registry with the open end of one of the chambers with the open end of the other chamber being blocked by the selector member, through a plurality of intermediate positions in which the opening is in registry with portions of the open ends of both of the chambers with the remaining portions of both of the chambers being blocked by the selector member to a second position in which the opening is in registry with the open end of the other chamber with the open end of the one chamber being blocked by the selector member. Upon compression of the outer container wall, a predetermined measure of flowable substance is dispensed from the dispensing end of the container with the ratio of the flowable substance from the two chambers which constitutes the predetermined measure being selectively variable from one hundred percent from the one chamber and zero percent from the other chamber when the selector member is in the first position to zero percent from the one chamber and one hundred percent from the other chamber when the selector member is in the second position to any desired ratio therebetween when the selector member is in an intermediate position.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENT

While this invention may be embodied in many different forms, this specification and the accompanying drawings disclose only some specific forms as examples of the use of the invention. The invention is not intended to be limited to the embodiment so described, and the scope of the invention will be pointed out in the appended claims.

Figure 1:
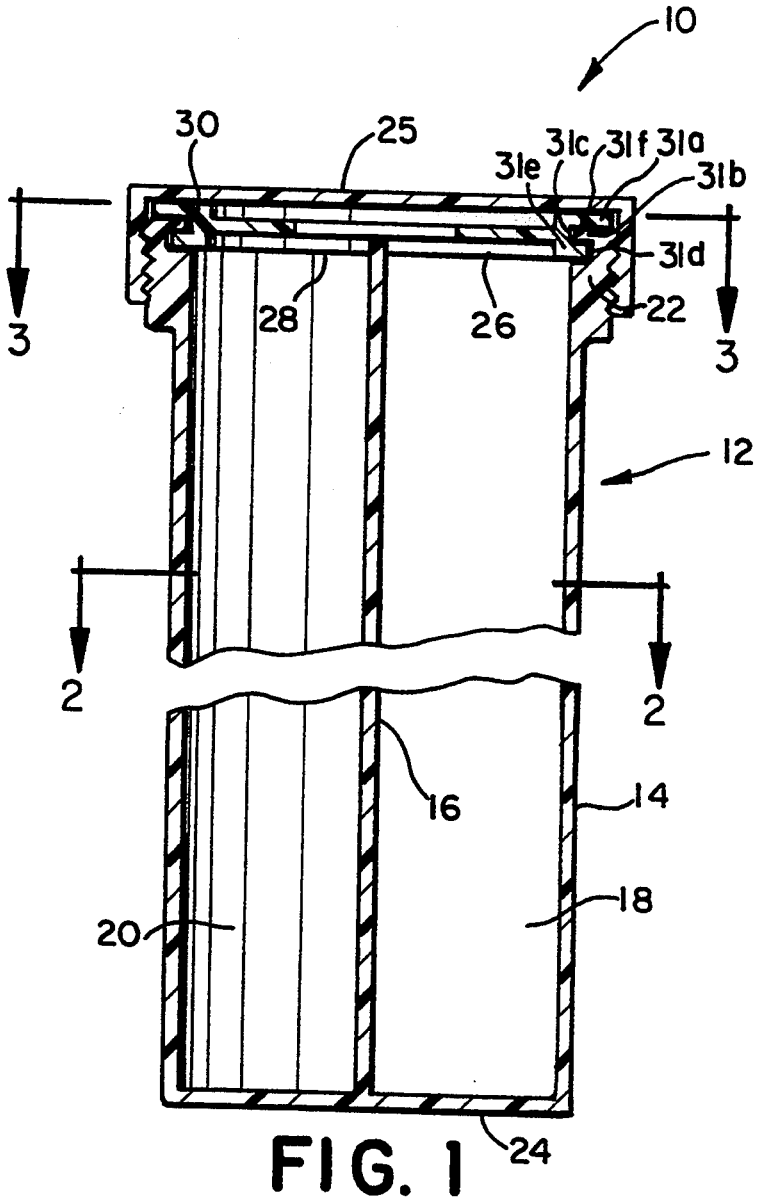
FIG. 1 is a longitudinal cross-sectional view of a first embodiment of a dispensing apparatus in accordance with the present invention.
Figure 2:
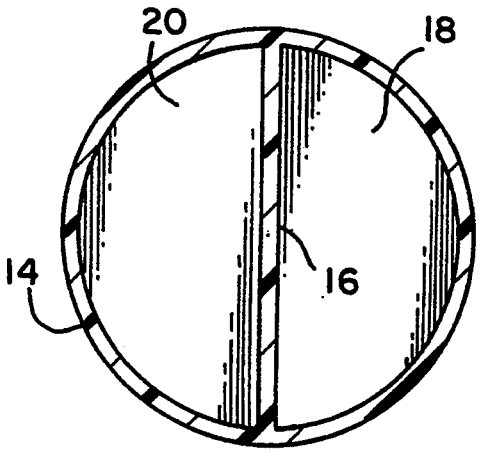
FIG. 2 is a cross-sectional view of the dispensing apparatus shown in FIG. 1 taken along lines 2—2 of FIG. 1.
Figure 3:
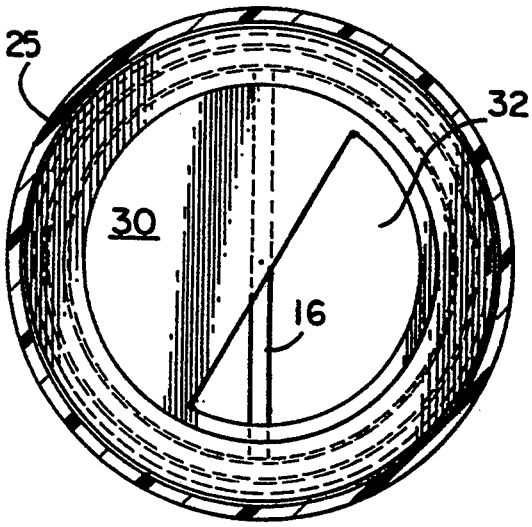
FIG. 3 is a cross-sectional view of the dispensing apparatus shown in FIG. 1 taken along lines 3—3 of FIG. 1.

Referring now to the drawings in detail, wherein like numerals are used to indicate like elements throughout, there is shown in FIGS. 1, 2 and 3 a first embodiment of a dispensing apparatus, generally designated 10, for dispensing two flowable substances in a user selectable ratio. FIG. 1 is a longitudinal cross-sectional view of the dispensing apparatus 10, hereinafter referred to as the dispenser 10. The dispenser 10 includes a container 12 having a flexible, generally continuous outer wall 14 and a flexible inner diaphragm 16. As shown in FIG. 2, the diaphragm 16 separates the container 12 into two generally equal chambers 18, 20 which are generally semi-circular in cross section. The chambers 18, 20 are for each receiving a different flowable substance. The two substances are of a type which are to be mixed together in a desired ratio when dispensed from the container 12.

As shown in FIG. 1, the container 12 has a generally open, externally threaded dispensing end 22 and a generally closed end 24. On the threaded end 22 is screwed a terminal cap 25. Each of the chambers 18, 20 has an open end 26, 28 opening proximate the dispensing end 22 of the container 12. In the present embodiment, the container 12 is preferably generally cylindrical in shape and the container 12, the diaphragm 16 and the cap 25 are formed or molded from a polymeric material. However, it is understood by those skilled in the art that other shapes, configurations, materials and fabrication methods are suitable for the container 12, the diaphragm 16 and the cap 25. For example, the wall 14 of the container 12 and the diaphragm 16 can be formed from an elastic material which permits the user to squeeze the outer wall 14 during a dispensing operation which in turn allows the diaphragm 16 to displace or flex in response to a resulting pressure differential between the chambers 18, 20. The cap 25 should preferably be formed of a non-elastic, more rigid material such as a rigid plastic. It is also understood by those skilled in the art that the selection of material for the container 12, diaphragm 16 and cap 24 depends upon and must be compatible with the type of flowable substances being dispensed.

A selector member 30 is disposed between the open ends 26, 28 of the chambers 18, 20 and the dispensing end 22 of the container 12, with the selector member 30 being selectively rotatable by a user with respect to the container 12. As shown in FIG. 1, the selector member 30 includes circular shoulder portions **31*a*, 31*e* spaced apart for defining a groove 31*c*. The dispensing end 22 of the container 12 includes an inwardly extending generally circular shoulder portion 31*b* received within the groove 31*c* of the selector member 30 and a generally circular groove 31*d* receiving the shoulder portion 31*e* of the selector member 30. The shoulder portion 31*a* of the selector member 30 rests on a top surface 31*f* of the container dispensing end 22. The shoulder portions 31*a*, 31*b*, 31*e* and the grooves 31*c* and 31*d* cooperate to hold the selector member 30 in place while permitting rotation of the selector member 30 with respect to the container 12**.

In the present embodiment, the selector member 30 is generally a flat disk-like member preferably formed of generally rigid polymeric material. The shoulder portion **31*e* and the groove 31*c* of the selector member 30 are each of a lesser diameter than the corresponding groove 31*d* and shoulder portion 31*b* on the dispensing end 22 of the container 12** to enable the selector member 30 to be selectively rotatable with respect to the container 12.

The selector member 30 includes a single opening 32 extending completely therethrough. The opening 32 is of a predetermined size and a predetermined shape. In the present embodiment shown in FIGS. 1–3 in which the container 12 is cylindrical and the chambers 18, 20 are semi-circular in cross section, the selector member opening 32 is generally semi-circular in shape and is sized to generally correspond to the cross-sectional size of each of the chambers 18, 20. It will be appreciated by those skilled in the art that the size and shape of the selector member opening 32 may vary depending upon the size and shape of the container and depending upon the particular application or use.

In use, the chambers 18,20 of the dispensing apparatus 10 are initially filled with two different but preferably compatibly mixable flowable substances. The selector member 30 is then rotated with respect to the container 12 by a user to a position for dispensing the two substances in a desired ratio. The selector member 30 may be rotated to a first position, in which the opening 32 is in registry with the open end 26 of one chamber 18 with the open end 28 of the other chamber 20 being completely blocked or restricted by the selector member 30. The selector member 30 may also be rotated to a second position in which the opening 32 is in registry with the open end 28 of the other chamber 20 with the open end 26 of the one chamber 18 being blocked or restricted by the selector member 30. The selector member 30 may also be rotated to a plurality of intermediate positions between the first and second positions (one of which is shown in FIG. 3) in which the opening 32 is in registry with portions of the open ends 26,28 of each of the chambers 18,20 with the remaining portions of each of the chambers 18,20 being blocked or restricted by the selector member 30.

The flexible outer wall 14 of the container 12 is then compressed by the user, causing the flexible diaphragm 16 to displace in response to the higher pressure created by flow resistance from one of the chambers 18,20. This, in turn, causes an increase in the pressure on the other of the chambers 18,20 having a lower flow resistance resulting in a pressure differential between chambers 18,20, hence allowing for predictable variation in the total volume of flowable substances displaced from each of the chambers 18,20. Thus, a predetermined measure of flowable substances is dispensed from the dispensing end 22 of the container 12 with the ratio of the flowable substances from the two chambers 18,20 being selectively variable due to the position of the selector member 30 from one hundred percent from chamber 18 and zero percent from chamber 20 when the selector member 30 is in the first position to zero percent from chamber 18 and one hundred percent from chamber 20 when the selector member 30 is in the second position to any desired ratio therebetween when the selector member 30 is in an intermediate position.

Figure 4:
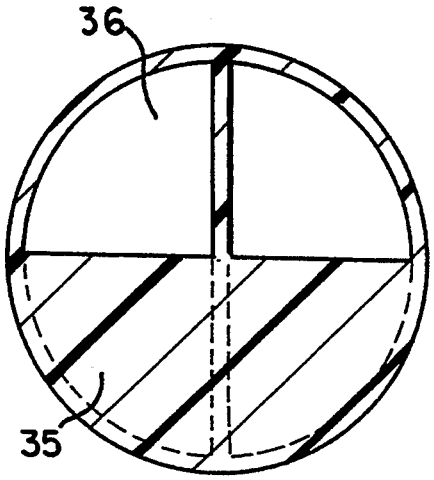
FIG. 4 is a cross-sectional view of a second embodiment of a dispensing apparatus in accordance with the present invention.
Figure 5:
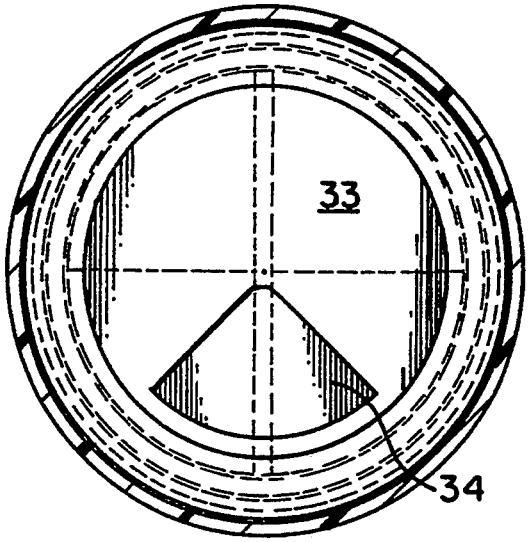
FIG. 5 is another cross-sectional view of the second embodiment of the dispensing apparatus.

A dispensing apparatus according to a second embodiment of the invention, as shown in FIGS. 4 and 5, includes the same elements of the apparatus previously described with reference to FIGS. 1–3. However, in the second embodiment the selector member 33 includes a single opening 34 generally in the shape of one-quarter of a circle with a size corresponding to approximately one-half of the open ends 26,28 of chambers 18,20, respectively. In addition, a generally semi-circular blocking member 35 is disposed between the open ends 26,28 of the chambers 18,20 and the selector member 33. The blocking member 35 has a generally semi-circular opening 36 extending therethrough and is positioned with respect to the chambers 18,20 such that one-half of the open end 26,28 of each of the chambers 18,20 is constantly blocked by the blocking member 35. In the present embodiment, the blocking member 35 is formed integrally with the container 12. However, it is understood by those skilled in the art that other materials and forms of construction are suitable for the container 12 and blocking member 35.

The dispensing apparatus according to the second embodiment of the invention operates essentially the same as the dispensing apparatus previously described with reference to FIGS. 1–3. The only difference is that rotation of the selector member 33 with respect to the container 12 so as to be in registry with the unopened portion of the blocking member 35 precludes dispensing of either of the flowable substances from the chambers 18,20.

Referring now to FIGS. 6–9, there is shown a third preferred embodiment of the dispensing apparatus of the present invention, generally designated 38, for dispensing two flowable substances in a user selectable ratio. The third embodiment comprises a generally cylindrical container 40 having a generally continuous outer wall 42 and an inner partition member 44. The partition member 44 separates the container 40 into two generally equal chambers 46, 48 which are generally semi-circular in cross- section. The container 40 has a generally open, externally threaded dispensing end 50 and a generally closed end 52. Each chamber 46, 48 has an end 54, 56 generally open proximate the dispensing end 50 of the container 40. In the present embodiment, the container 40 is preferably generally cylindrical in shape and the container 40 and the partition member 44 are formed or molded from a polymeric material, such as a resilient or rigid plastic. However, it is understood by those skilled in the art that other shapes, configurations, materials and fabrication methods are suitable for the container 40 and partition 44.

The dispensing apparatus 38 includes a selector member 58 disposed between the open ends 54, 56 of the chambers and the dispensing end 50 of the container 40, with the selector member 58 being selectively rotatable with respect to the container 40. The selector member 58 has a single opening 60 extending therethrough. According to the present embodiment, the selector member 58 is preferably substantially the same as selector member 30 previously described with reference to FIGS. 1–3. Additionally, the selector member 58 is interconnected with dispensing end 50 of the container 40 in the manner previously described for the interconnection between the selector member 30 and the dispensing end 22 of the container 12 with reference to FIGS. 1–3 in order to permit the selector member 58 to be selectively rotatable with respect to the container 40.

Figure 6:
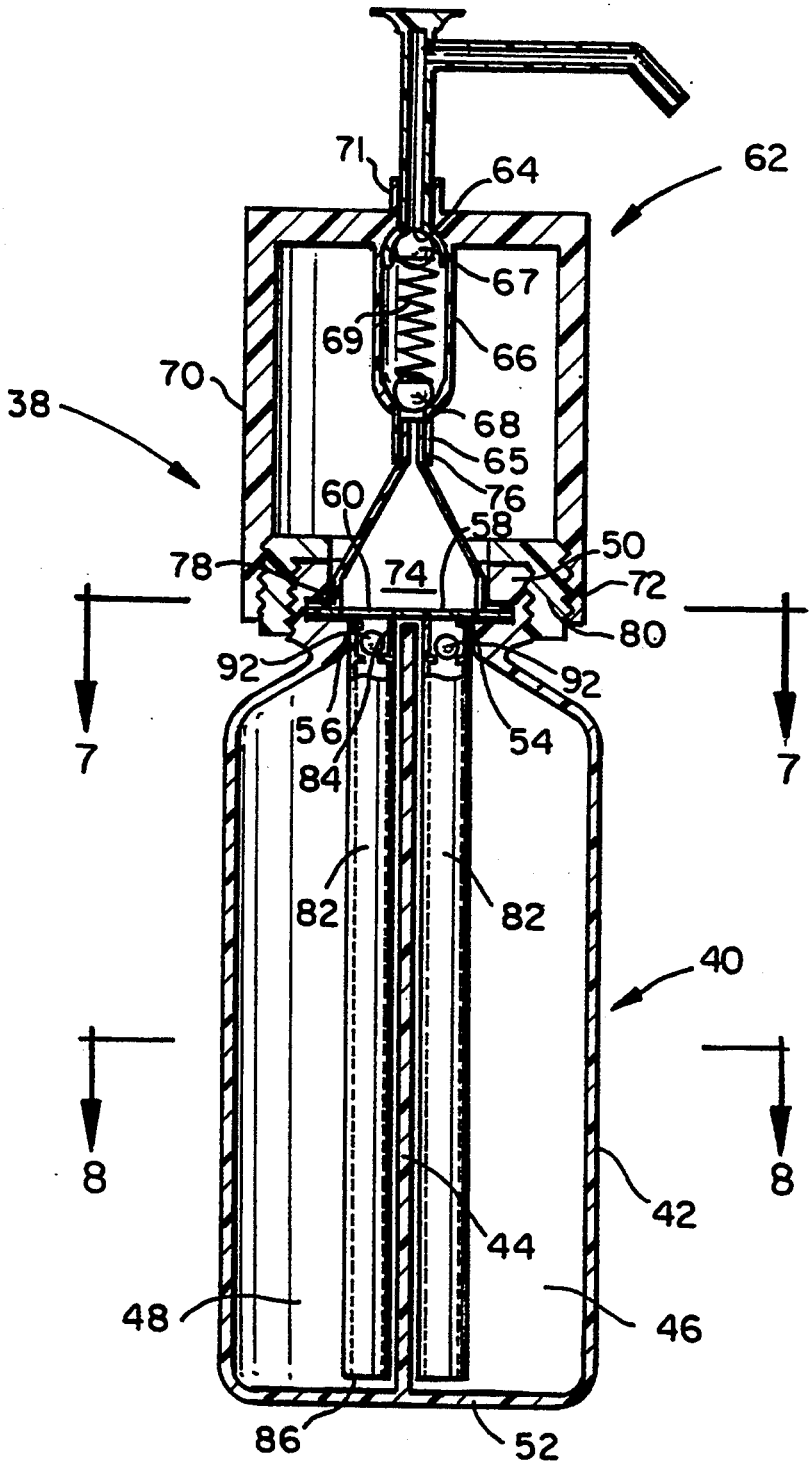
FIG. 6 is a longitudinal cross-sectional view of a third embodiment of a dispensing apparatus in accordance with the present invention.

The dispensing apparatus 38 further includes a pump generally designated as 62. The pump 62, which is of a type generally well known in the dispensing arts, includes a dispensing outlet 64 and an inlet end 65. A housing member 66 is disposed between the inlet end 65 and outlet 64 for connecting the inlet end 65 with the dispensing outlet 64. Within housing member 66 are enclosed upper and lower ball members 67,68 and a spring member 69 biasing the upper 67 and lower 68 ball members respectively against the dispensing outlet 64 and the inlet end 65 to form a pair of one way check valves. An upper cap member 70 has a first end 71 for supporting the dispensing outlet 64 of the pump 62 and a second internally threaded end 72 which is threadingly secured to the dispensing end 50 of the container 40. As shown in FIG. 6, the pump 62 of the present embodiment is a standard double ball valve actuator pump which is commonly used in dispensers for dispensing skin lotions, liquid soaps and many other substances. However, it is understood by those skilled in the art that other types of pumps which can provide suction to the dispensing end 50 of the container 40 may be employed in the alternative.

A mixing chamber 74 is disposed between the selector member 58 and the inlet end 65 of the pump 62 for receiving and mixing together the selected ratio of the flowable substances. The mixing chamber 74 includes a first end 76 and a second end 78. The second end 78 of the mixing chamber 74 is in fluid communication with the open ends 54, 56 of each chamber 46, 48 through the selector member opening 60 and the first end 76 of the mixing chamber 74 is in fluid communication with the inlet end 65 of the pump 62. An internally and externally threaded lower cap member 80 releasably secures the mixing chamber 74 with the externally threaded dispensing end 50 of the container 40. Preferably, the mixing chamber 74 is generally of a tapered frusto-conical shape and the lower cap member 80 includes an opening with a generally tapered surface engaging the tapered surface of the mixing chamber 74. The mixing chamber 74 and the lower cap member 80 are preferably formed or molded from a polymeric material. However, it is understood by those skilled in the art that other shapes, configurations, materials and fabrication methods are suitable for the mixing chamber 74 and lower cap member 80.

Figure 9:
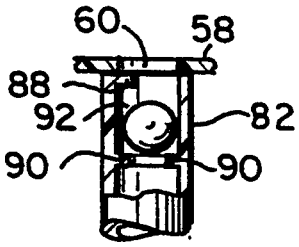
FIG. 9 is an enlarged fragmentary view of a ball check valve arrangement of the dispensing apparatus of FIG. 6.
Figure 7:
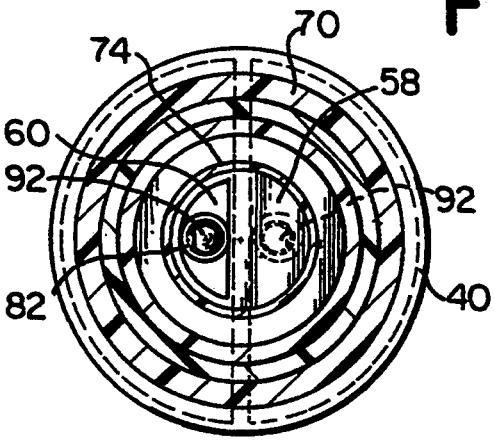
FIG. 7 is a cross-sectional view of the dispensing apparatus shown in FIG. 6 taken along lines 7—7 of FIG. 6.
Figure 8:
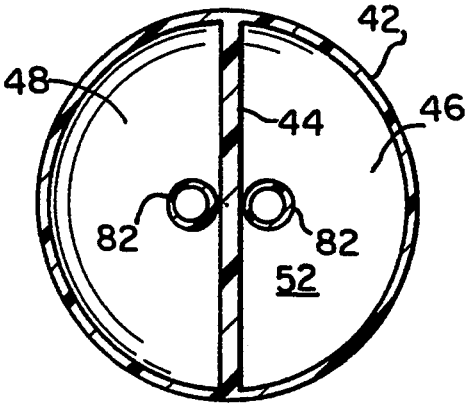
FIG. 8 is a cross-sectional view of the dispensing apparatus shown in FIG. 6 taken along line 8—8 of FIG. 2.

Referring now to FIGS. 6 and 9, an elongated tube 82 is positioned within each chamber 46, 48. Each tube has a first end 84 and a second end 86. The first end 84 of each tube 82 is maintained proximate the open end 54, 56 of each respective chamber 46, 48. As shown in FIG. 9, the first end 84 of each tube 82 includes pairs of upper and lower stop members 88,90. A ball 92 is positioned within each tube 82 and between each pair of upper 88 and lower 90 stop members to establish a check valve. Each pair of lower stop members 90 within each tube 82 defines an opening 94 through which a flowable substance from each respective chamber 46,48 passes as the flowable substance flows from each of the chambers 46,48 through the selector member 58 and into the mixing chamber 74 during operation of pump 62. The balls 92 sit against the lower stop members 90 in the absence of activation of the pump to prevent flowable substances which are mixed together in the mixing chamber 74 from flowing back into either of the chambers 46,48. According to the present embodiment, the stop members 88, 90 are in the form of projections extending into each tube 82 proximate the first end 76 and the balls 92 are spherical in construction. However, it is understood by those skilled in the art that other forms of construction for stop members 88,90 and balls 92 are suitable. The second ends 86 of each tube 82 are located proximate the lower, closed ends of each chamber 46,48 to facilitate removal of the flowable substances.

It is understood by those skilled in the art that the selection of material for the container 40, the selector member 58, the tubes 82, the balls 92, the mixing chamber 74 and the pump 62 should be compatible with the type of flowable substance being used.

Referring to FIG. 6, full assembly of the dispensing apparatus of the present embodiment is accomplished as the end 72 of the upper cap member 70 threadingly engages the external threads of the lower cap member 80 to attach the pump 62 in fluid communication with the dispensing end 50 of the container 40. In use, chambers 46,48 of the dispensing apparatus 38 are filled with different, compatible flowable substances. The selector member 58 is selectively rotated relative to the container 40 to achieve a desired ratio of registry between the selector member opening 60 and each of the chamber open ends 54,56 as previously described with reference to the first embodiment of the present invention.

Prior to activating the pump 38 by exerting a downward force on the dispensing outlet 64, the spring member 69 within the housing member 66 biases the upper ball member 67 and the lower ball member 68 respectively against the dispensing outlet 64 and the inlet end 65 of the pump 62 to secure a mixture of the flowable substances within the housing member 66 from a previous mixing operation. In addition, each ball 92 disposed within each tube 82 is seated on the lower stop members 90 prevent the mixed flowable substances in the mixing chamber 74 from flowing into the chambers 46,48.

Upon application of a downward force on the dispensing outlet 64 of the pump 38, the mixture within the housing member 66 is compressed, forcing the upper ball member 67 to displace downward and the lower ball member 68 to close the inlet end 65. The mixture within the housing member 66 concurrently flows around the upper ball member 64 and is dispensed through the dispensing outlet 64.

Upon release of the dispensing end 62 the upper ball member 67 closes the dispensing outlet 64 and the housing member 66 is expanded, creating a partial vacuum therein which causes the lower ball member 68 to rise and open the inlet end 65, placing the housing member 66 in fluid communication with the mixing chamber 74. The mixture within the mixing chamber 74 is drawn by the partial vacuum into the housing member 66, creating yet another partial vacuum within the mixing chamber 74 which forces the balls 92 to rise from the lower stop members 90 and open the opening 94 defined by each pair of the lower stop members 90. The upper stop members 88 prevent the balls 92 from passing through the selector member opening 60. The flowable substance from each of the chambers 46, 48 is drawn through each respective tube 82, around each respective ball 92, through the selector member opening 60 in selected ratios and into the housing member 66 and the mixing chamber 74. When the housing member 66 and the mixing chamber 74 are filled to capacity with the mixture of the flowable substances, normal gravitational forces push balls 92 to seat against the lower stop members 92. Thus, the tubes 82, the lower stop members 90 and the balls 92 establish a one-way check valve which prevents the flowable substances which are mixed together in the mixing chamber from flowing back into either of chambers 46, 48. Hence, contamination of the different flowable substances within each of the chambers 46,48 is prevented.

From the foregoing description, it can be seen that the present invention comprises an improved apparatus for dispensing two flowable substances in a user selectable ratio. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for dispensing a composite flowable substance having a user selectable ratio of two different flowable substances, the apparatus comprising:

a. a container having a flexible generally continuous outer wall and a flexible inner diaphragm separating the container into two generally equal chambers, each chamber for receiving one of the different flowable substances, the container having a generally open dispensing end and a generally closed end, each of the chambers having an end generally open proximate the dispensing end of the container; and b. a selector member disposed between the open ends of the chambers and the dispensing end of the container, the selector member having a single opening of a predetermined size and a predetermined shape extending therethrough, the selector member being selectively rotatable with respect to the container from a first position in which the opening is in registry with the open end of one of the chambers with the open end of the other chamber being blocked by the selector member, through a plurality of intermediate positions in which the opening is in registry with portions of the open ends of both of the chambers with the remaining portions of the open ends of both of the chambers being blocked by the selector member to a second position in which the opening is in registry with the open end of the other chamber with the open end of the one chamber being blocked by the selector member, the composite flowable substance being dispensed from the dispensing end of the container upon compression of the outer container wall, the ratio of each of the different flowable substances being selectively variable from one hundred percent from the one chamber and zero percent from the other chamber when the selector member is in the first position to zero percent from the one chamber and one hundred percent from the other chamber when the selector member is in the second position to any desired ratio therebetween when the selector member is in any intermediate position.

2. The dispensing apparatus as recited in claim 1 wherein the container is generally cylindrical and wherein each of the chambers is generally semi-circular in cross-section.

3. The dispensing apparatus as recited in claim 2 wherein the selector member opening is generally semi-circular in shape and is sized to correspond to the cross-sectional size of the chambers.

4. The dispensing apparatus as recited in claim 3 wherein the selector member is in a generally circular disk-shaped member.

5. The apparatus as recited in claim 2 further comprising a generally circular blocking member disposed between the open ends of the chambers and the selector member, the blocking member having a generally semi-circular opening extending therethrough and being positioned with respect to the chambers such that one-half of the open end of each of the chambers is blocked and wherein the selector member opening is generally in the shape of one-quarter of a circle with a size corresponding to one-half of the open end of one of the chambers whereby rotation of the selector member to be in registry with the unopened portion of the blocking member precludes dispensing of either of the flowable substances.

6. An apparatus for dispensing two flowable substances in a user selectable ratio comprising:

(a) a container having a generally continuous outer wall and an inner partition member separating the container into two generally equal chambers, each chamber for receiving a different flowable substance, the container having a generally closed end and a dispensing end, each chamber having an end generally open proximate the dispensing end of the container;

(b) a selector member disposed between the open ends of the chambers and the dispensing end of the container, the selector member having a single opening extending therethrough and being operable to adjustably restrict a flow of the flowable substances from each chamber through the opening in the selector member to dispense a selected ratio of the flowable substances; and (c) a pump having an inlet in fluid communication with the selector member opening and a dispensing outlet, whereby upon activation of the pump, the selected ratio of flowable substances is delivered from the chambers through the selector member and is dispensed from the dispensing outlet of the pump.

7. The apparatus as recited in claim 6 further comprising a mixing chamber disposed between the selector member and the pump inlet having first and second open ends, the second end of the mixing chamber being in fluid communication with the selector member opening for receiving and mixing together the selected ratio of the flowable substances and the first end of the mixing chamber being in fluid communication with the pump inlet.

8. The dispensing apparatus as recited in claim 7 wherein the mixing chamber is generally frusto-conically shaped.

9. The dispensing apparatus as recited in claim 6 further comprising a tube positioned within each chamber, each tube having first and second open ends, the first end of each tube being proximate the open end of each respective chamber, the tubes being operable to transport the flowable substances from each of the chambers to the pump.

10. The apparatus as recited in claim 8 further comprising a check valve positioned within each tube.

11. The dispensing apparatus as recited in claim 6 wherein the opening of the selector member is of a predetermined size and a predetermined shape, the selector member being selectively rotatable with respect to the container from a first position in which the selector member opening is in registry with the open end of one of the chambers with the open end of the other chamber being blocked by the selector member, through a plurality of intermediate positions in which the selector member opening is in registry with portions of the open ends of both of the chambers with the remaining portions of both of the chambers being blocked by the selector member to a second position in which the selector member opening is in registry with the open end of the other chamber with the open end of the one chamber being blocked by the selector member, the ratio of flowable substance being selectively variable from one hundred percent from the one chamber and zero percent from the other chamber when the selector member is in the first position to zero percent from the one chamber and one hundred percent from the other chamber when the selector is in the second position to any desired ratio therebetween when the selector member is in an intermediate position.

12. The dispensing apparatus as recited in claim 11 wherein the container is generally cylindrical and wherein each of the chambers is generally semi-circular in cross-section.

13. The dispensing apparatus as recited in claim 12 wherein the selector member opening is generally circular in shape and is sized to correspond to the cross-sectional size of the chambers.

14. The dispensing apparatus as recited in claim 13 wherein the selector member is a generally circular disk-like member.

15. The dispensing apparatus as recited in claim 12 further comprising a generally semi-circular blocking member disposed between the open ends of the chambers and the selector member, the blocking member having a generally semi-circular opening extending therethrough and being positioned with respect to the chambers such that one-half of the open end of each of the chambers is blocked and wherein the selector member opening is generally in the shape of one-quarter of a circle with a size corresponding to one-half of the open end of one of the chambers whereby rotation of the selector member to be in registry with the unopened portion of the blocking member precludes dispensing of either of the flowable substances.

16. An apparatus for dispensing two flowable substances in a user selectable ratio comprising:

(a) a container having a generally continuous outer wall and an inner partition member separating the container into two generally equal chambers, each chamber for receiving a different flowable substance, the container having a generally closed end and a dispensing end, each chamber having an end generally open proximate the dispensing end of the container;

(b) a selector member disposed between the open ends of the chambers and the dispensing end of the container, the selector member having a single opening of a predetermined size and a predetermined shape extending therethrough, the selector member being selectively rotatable with respect to the container from a first position in which the selector member opening is in registry with the open end of one of the chambers with the open end of the other chamber being blocked by the selector member, through a plurality of intermediate positions in which the selector member opening is in registry with portions of the open ends of both of the chambers with the remaining portions of both of the chambers being blocked by the selector member to second position in which the selector member opening is in registry with the open end of the other chamber with the open end of the one chamber being blocked by the selector member;

(c) a pump having an inlet in fluid communication with the selector member opening and a dispensing outlet, whereby upon activation of the pump, a predetermined measure of the flowable substances is dispensed from the dispensing outlet of the pump with the ratio of the flowable substances from the two chambers which constitutes the predetermined measure being selectively variable from one hundred percent from the one chamber and zero percent from the other chamber when the selector member is in the first position to zero percent from the one chamber and one hundred percent from the other chamber when the selector member is in the second position to any desired ratio therebetween when the selector member is in an intermediate position.

17. The apparatus as recited in claim 16 further comprising a mixing chamber disposed between the selector member and the pump inlet having first and second open ends, the second end of the mixing chamber being in fluid communication with the selector member opening for receiving and mixing together the selected ratio of the flowable substances and the first end of the mixing chamber being in fluid communication with the pump inlet.

18. The apparatus as recited in claim 16 further comprising a tube positioned within each chamber, each tube having first and second open ends, the first end of each tube being proximate the open end of each respective chamber, the tubes being operable to transport the flowable substances from each the chambers to the pump.

19. The apparatus as recited in claim 18 further comprising a check valve positioned within each tube.

* * * * *

UNITED STATES PATENT AND TRADEMARK OFFICE

CERTIFICATE OF CORRECTION

PATENT NO. : 5,385,270

DATED : January 31, 1995

INVENTOR(S) : Ralph J. Cataneo et al.

It is certified that error appears in the above-indentified patent and that said Letters Patent is hereby corrected as shown below:

Column 2, the words bridging lines 34 and 35: delete "created" and insert --eliminated-- therefor.

Signed and Sealed this

FourthDay of August, 1998

Bruce Lehman

*Attest:*

BRUCE LEHMAN

*Attesting Officer*

*Commissioner of Patents and Trademarks*